US006695627B2

(12) United States Patent
Ortega et al.

(10) Patent No.: US 6,695,627 B2
(45) Date of Patent: Feb. 24, 2004

(54) PROFILED HEADER GROUND PIN

(75) Inventors: Jose L. Ortega, Camp Hill, PA (US); Stanley W. Olson, East Berlin, PA (US)

(73) Assignee: FCI Americas Technnology, Inc., Reno, NV (US)

( * ) Notice: Subject to any disclaimer, the term of this patent is extended or adjusted under 35 U.S.C. 154(b) by 335 days.

(21) Appl. No.: 09/921,352

(22) Filed: Aug. 2, 2001

(65) Prior Publication Data

US 2003/0027442 A1 Feb. 6, 2003

(51) Int. Cl.[7] ..... H01R 12/00

(52) U.S. Cl. ..... 439/78; 439/701; 439/108; 439/884; 439/682; 439/660

(58) Field of Search ..... 439/78, 108, 701, 439/884, 885, 682, 660

(56) References Cited

U.S. PATENT DOCUMENTS

| | | | | |
|---|---|---|---|---|
| 4,601,527 A | | 7/1986 | Lemke | 339/14 R |
| 4,686,607 A | | 8/1987 | Johnson | 361/413 |
| 4,720,268 A | | 1/1988 | Weiss | 439/82 |
| 4,737,116 A | | 4/1988 | Slye et al. | 439/608 |
| 4,861,132 A | | 8/1989 | Moulin | 350/96.2 |
| 4,907,988 A | | 3/1990 | Tilse | 439/751 |
| 4,975,084 A | | 12/1990 | Fedder et al. | 439/608 |
| 5,116,263 A | | 5/1992 | Bennett et al. | 439/733 |
| 5,174,770 A | | 12/1992 | Sasaki et al. | 439/108 |
| 5,197,893 A | | 3/1993 | Morlion et al. | 439/101 |
| 5,310,354 A | | 5/1994 | Oswald, Jr. | 439/108 |
| 5,588,851 A | | 12/1996 | Morlion et al. | 439/108 |
| 5,620,340 A | | 4/1997 | Andrews | 439/608 |
| 5,660,551 A | * | 8/1997 | Sakurai | 439/108 |
| 5,664,968 A | | 9/1997 | Mickievicz | 439/608 |
| 5,667,392 A | | 9/1997 | Kocher et al. | 439/79 |
| 5,761,050 A | | 6/1998 | Archer | 361/791 |
| 5,775,947 A | | 7/1998 | Suzuki et al. | 439/608 |
| 5,813,871 A | | 9/1998 | Grabbe et al. | 439/108 |
| 5,839,925 A | | 11/1998 | Simmons | 439/852 |
| 6,030,234 A | | 2/2000 | Berg et al. | 439/67 |
| 6,053,751 A | | 4/2000 | Humphrey | 439/108 |
| 6,098,281 A | | 8/2000 | Rudi | 29/845 |
| 6,116,926 A | | 9/2000 | Ortega et al. | 439/108 |
| 6,129,555 A | | 10/2000 | Daikuhara et al. | 439/608 |
| 6,159,048 A | * | 12/2000 | Van Koetsem et al. | 439/608 |
| 6,166,615 A | | 12/2000 | Winslow et al. | 333/260 |

FOREIGN PATENT DOCUMENTS

EP 0 907 225 A2 9/1998

OTHER PUBLICATIONS

Fusi, M.A. "Differential Signal Transmission Through High Speed Interconnects", Publication Date Unknown, 73–78.

* cited by examiner

*Primary Examiner*—Truc Nguyen
(74) *Attorney, Agent, or Firm*—Woodcock & Washburn LLP

(57) ABSTRACT

An electrical connector system includes a first connector having at least one receptacle contact and a second connector having at least one pin mated to the at least one receptacle contact. The pin may have a stem and a tip attached to the stem. The pin tip is designed to prevent misalignment of the pin or "pin side track" when mated to the receptacle contact and the mating forces that result from side tracking. In order to prevent this side tracking, the pin end may have a first flat side, a second flat side, a first side which connects the first flat side to the second flat side; and a second side which connects the first flat side to the second flat side. The pin tip flat sides minimize or reduce the likelihood of side tracking. The pin tip may also have other sides which are designed to prevent side tracking. For instance, the end of the pin tip may also be flat. Further the first and the second sides may each have a first portion which is angled from the tip and which connects to a second portion which is disposed substantially parallel to the stem.

28 Claims, 12 Drawing Sheets

PROFILED HEADER GROUND PIN

FIELD OF THE INVENTION

This invention relates to electrical connectors including electrical connectors having pins with profiled tips that reduce inserting forces on the pins.

BACKGROUND OF THE INVENTION

Many electrical connector systems include a receptacle connector and a plug connector which are mated together. The receptacle connector has a plurality of receptacle contacts for receiving a plurality of plug or pin contacts. The two connectors are mated together to form a connector system. When the connectors are mated, the plug or pins are inserted into the receptacle contacts and an electrical connection is formed between each pin and each receptacle contact.

The pins and the receptacle contacts are each relatively fragile. Therefore, it is important to ensure that the pin and the receptacle contacts are properly aligned. Any misalignment can cause increased insertion forces which can potentially damage the pins or the receptacle contacts. Insertion forces can also cause wear on the pin surfaces. Over time and with repeated insertions, this wear can damage the pin until it no longer can be mated with a receptacle and provide the requisite electrical connection.

Another problem with mating pins and receptacles is that the pin can "side track" along the side of a receptacle contact. This causes increased mating forces and premature pin wear.

This present invention includes electrical connector systems and electrical connectors which have profiled pins which are profiled to prevent or minimize insertion contact forces.

SUMMARY OF THE INVENTION

This invention includes a contact pin that has a stem and a profiled tip. The tip may have a plurality of sides and an end. Preferably, a first side of the tip extends substantially parallel to the stem. A second side of the tip is connected to the first side. The second side may have two sections; a first section that is disposed substantially parallel to the stem and a second section that extends at an angle from the first section to the end. The first side maintains the pin aligned as the pin is mated with a contact. By doing so, the first side prevents or minimized the likelihood of pin side tracking, which increases insertion forces on the pin.

Although it need not be, the end of the tip may be disposed substantially perpendicular to the stem and the first side. Angled portions may be used to connect the first side to the end.

The pin may further have a third side which is also disposed substantially parallel to the stem. The third side also assists in preventing side tracking. This third side can be connected to the second side at a corner. Additionally, the third side can be connected to the pin end by an angled portion.

The pin may further include a fourth side, which is connected to the first side and the third side at corners. The fourth pin side may include a first section that is disposed substantially parallel to the stem and a second section that extends from its first section to the end.

The contact pin of this invention may also include a second tip disposed at an opposing end of the pin stem. The second tip may have one or more of the features of the tip described above. In the broadest sense of the invention, the second tip, however, need not have any of those features. The contact pin is preferably a ground pin.

This invention also includes electrical connectors having at least one contact pin set forth above and preferably a plurality of the such pins. Moreover, this invention includes electrical connector systems which include a first and a second electrical connector. The first electrical connector may have at least one contact pin described above and preferably a plurality of the various pins set forth above. Disposed within the second electrical connector may be at least one and preferably a plurality of receptacle contacts for mating with the pins.

Other features of the invention are set forth below.

DETAILED DESCRIPTION OF THE INVENTION

Figure 1:
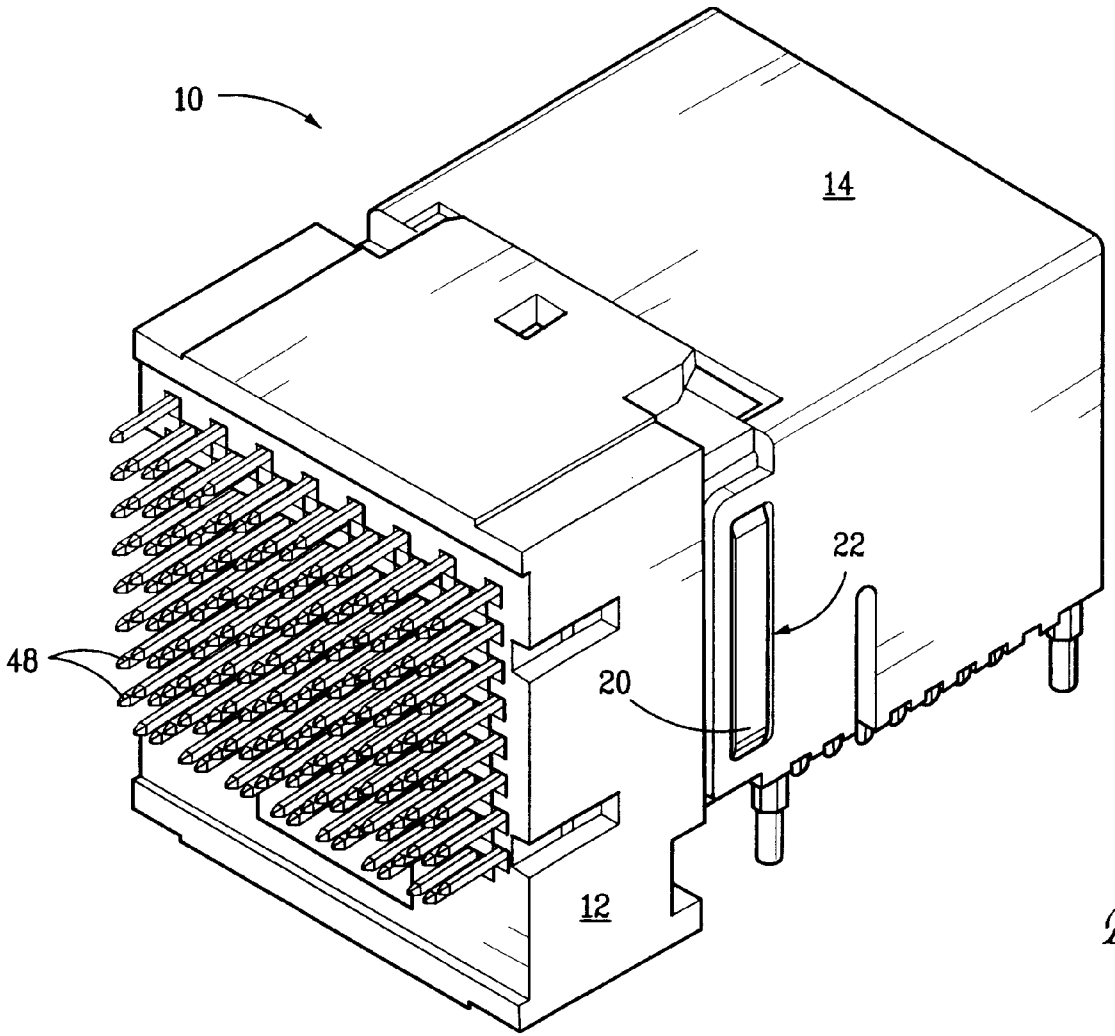
FIG. 1 is a perspective view of a preferred embodiment of the system of this invention with a first connector and a second connector mated.
Figure 2:
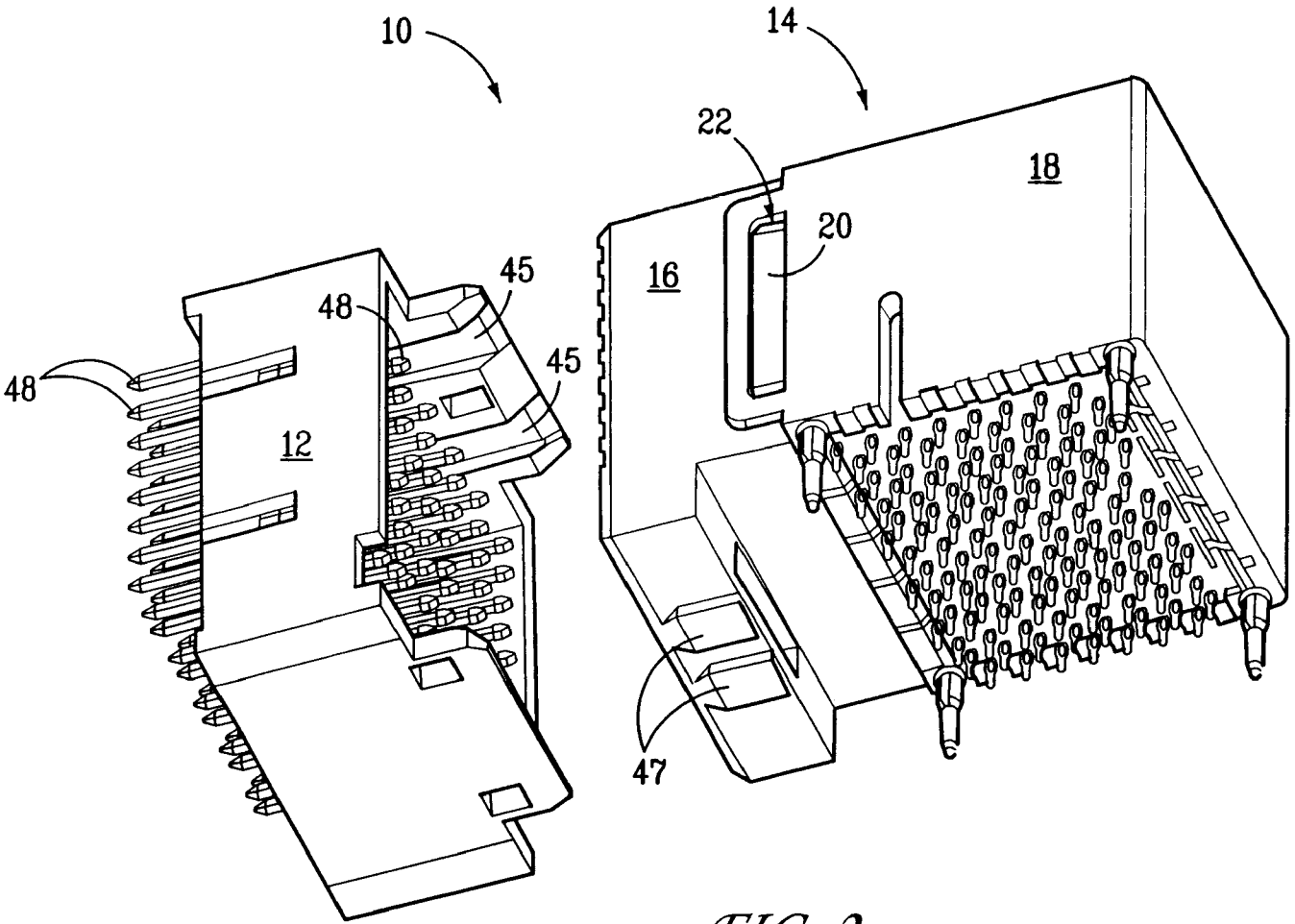
FIG. 2 is a perspective view of the first connector and the second connector of FIG. 1.

An embodiment of a connector system 10 of this invention is depicted in FIGS. 1 and 2. The connector system 10 preferably includes a first connector 12 and a second connector 14. The first connector 12 is preferably a pin connector, and the second connector 14 is preferably a receptacle connector. FIG. 1 depicts the pin connector 12 and the receptacle connector 14 mated, and FIG. 2 depicts the pin connector 12 and the receptacle connector prior to being mated. Although the connector system 10 may have a variety of applications, one such applications is as a high speed transmission connector system.

Figure 3:
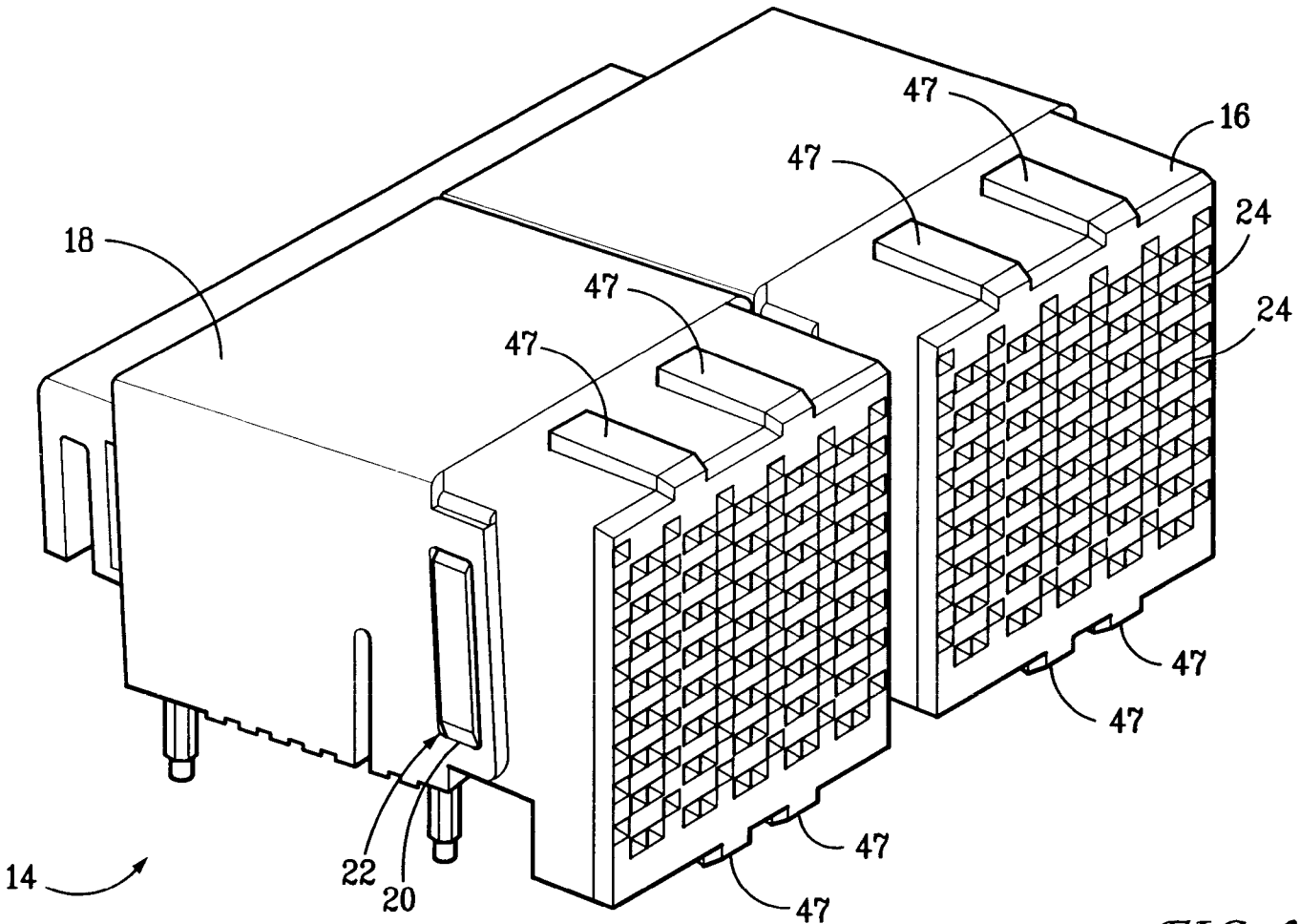
FIG. 3 is a perspective view of the second connector of FIGS. 1 and 2.

As shown in FIG. 3, the receptacle connector 14 may include a front housing 16 and a rear housing 18. Both the front and the rear receptacle housings 16, 18 are preferably a molded polymer and even more preferably a high temperature thermoplastic. FIG. 3 depicts the front housing 16 attached to the rear housing 18. Although the front and rear housings 16, 18 can be connected by any suitable means, they are connected in the preferred embodiment with tabs 20 in the front housing 16 which fit into openings 22 in the rear housing 18. As shown in FIG. 3, the front housing 16 may have a plurality of lead in apertures 24 for receiving pin and signal contacts of the pin connector 12, which are described below. The receptacle connector 14 is not new and is described in U.S. Pat. No. 6,116,926 ( the "926" patent), which is commonly assigned and which is hereby incorporated by reference in its entirety. The receptacle connector 14 can, however, be mated with the new pin connector 12 described below to form a new connector system 10. The receptacle connector 14 itself is novel in that it includes a new pin design which is described below.

Figure 4:
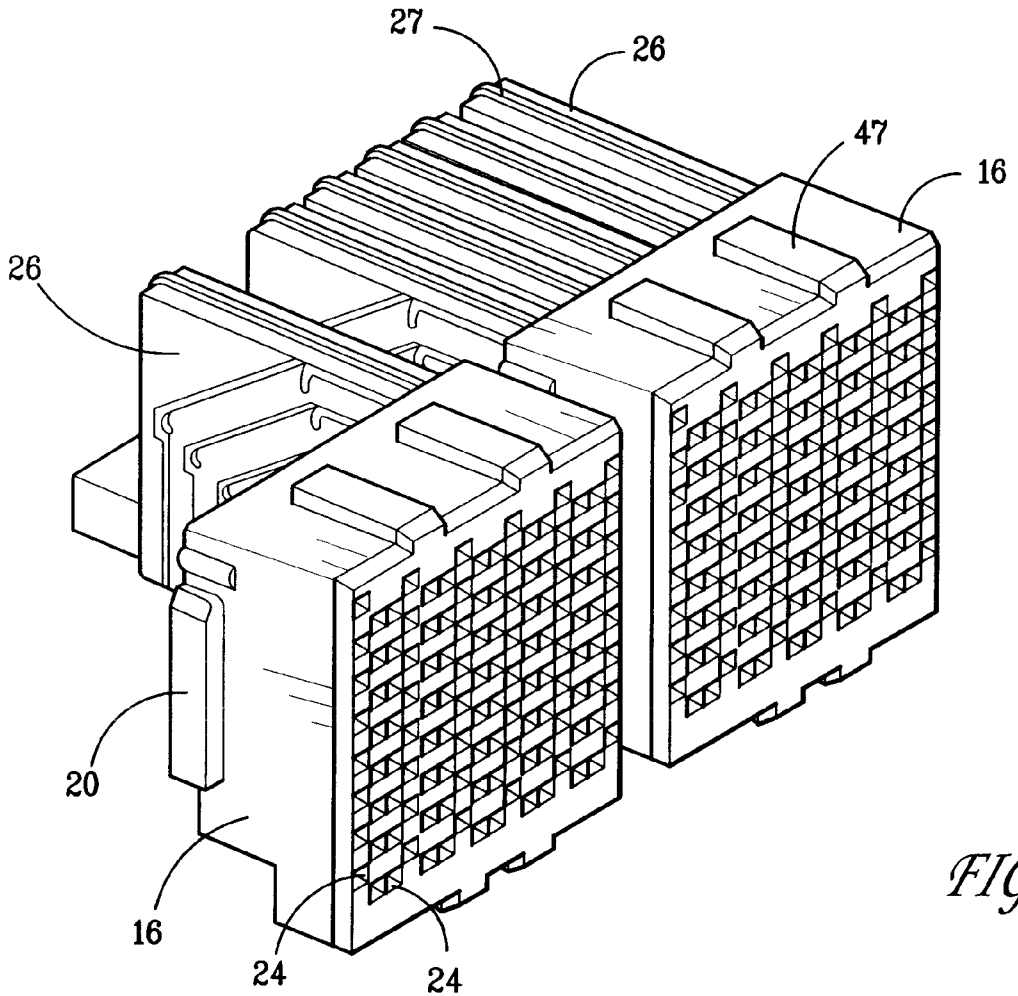
FIG. 4 is a perspective view of part of the second connector of FIG. 3.
Figure 5:
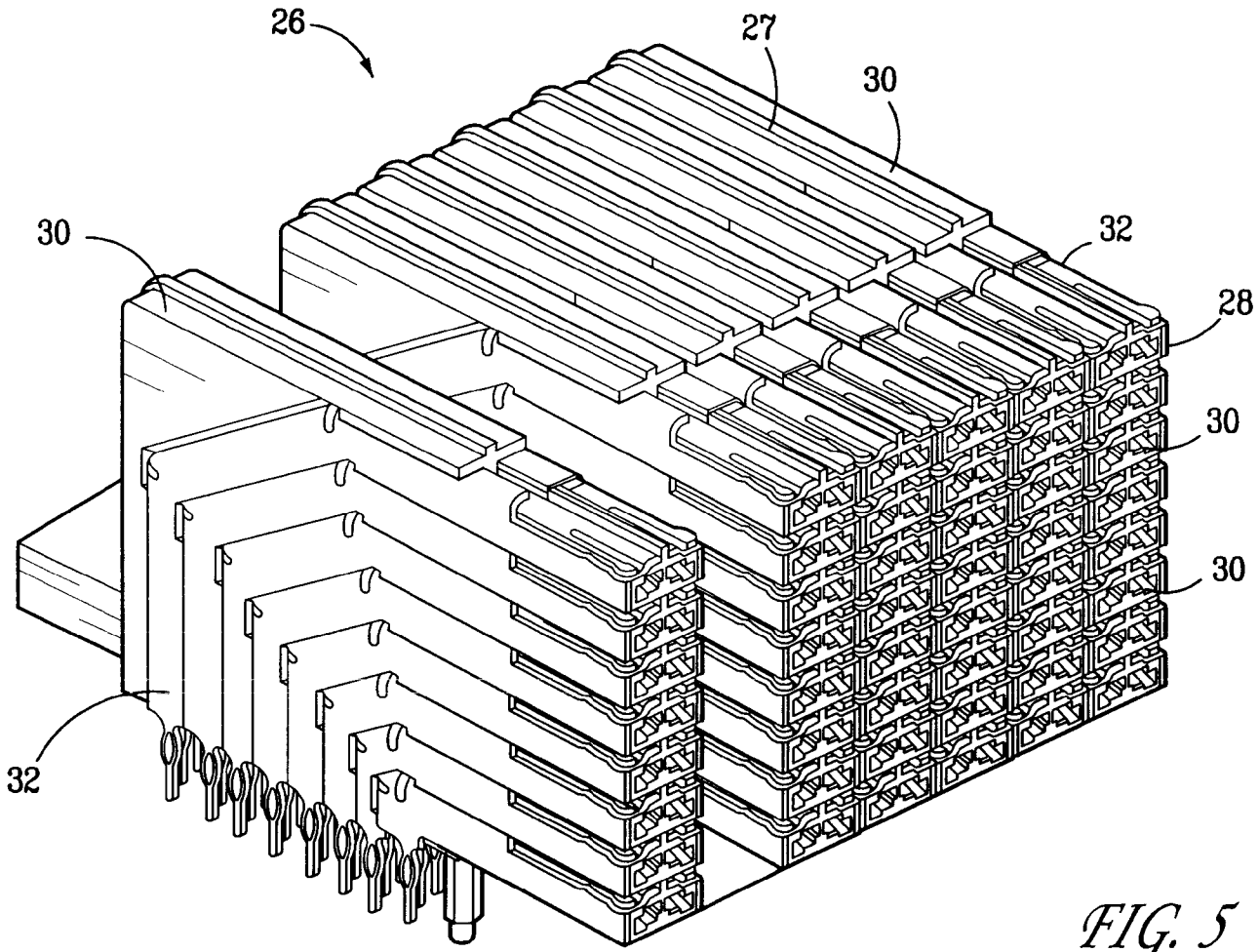
FIG. 5 is a perspective view of part of the second connector of FIG. 3.
Figure 6:
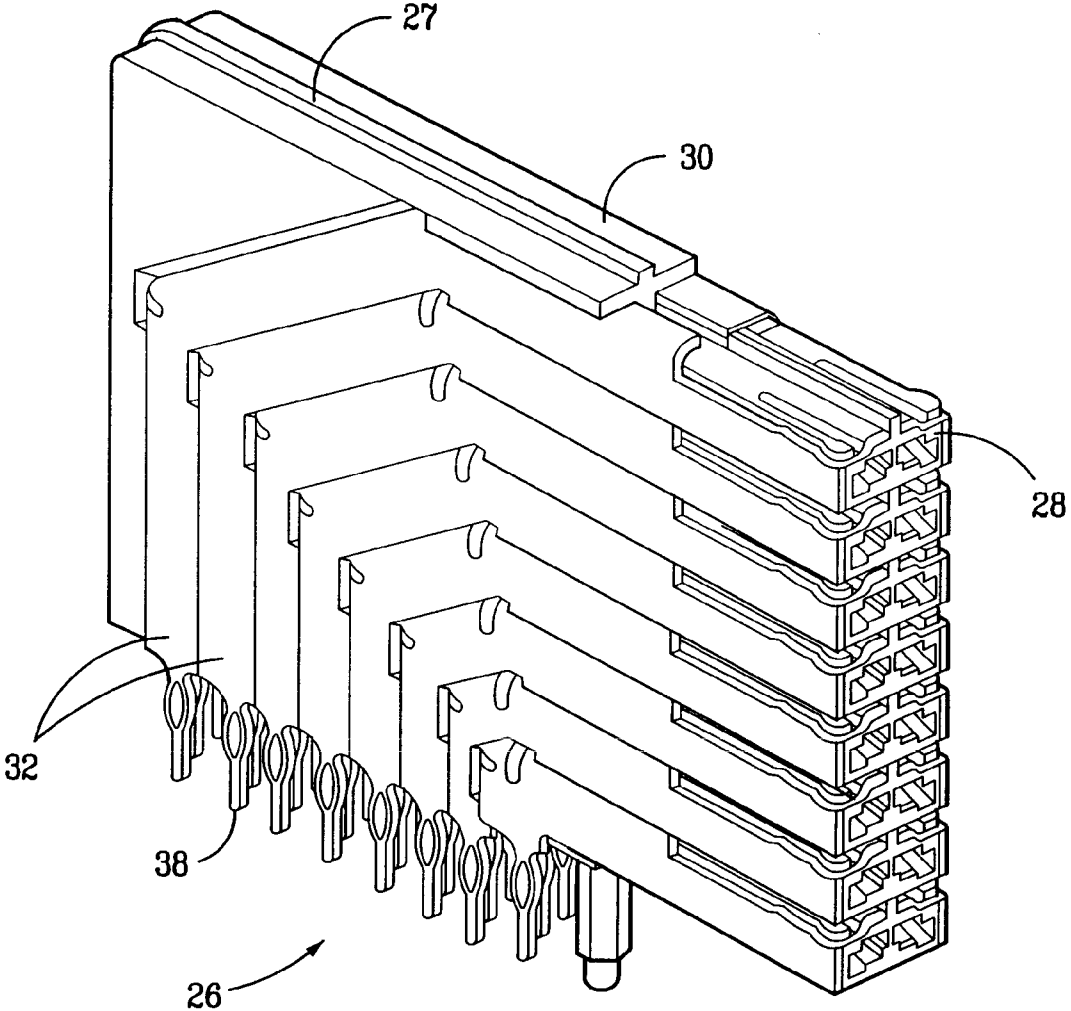
FIG. 6 is a perspective view of a plurality of modules of the second connector of FIG. 3.

FIG. 4 depicts the receptacle connector 14 with the rear housing 18 removed and a portion of the plurality of modules 26 installed. As explained below, each of the modules 26 has a plurality of receptacle ground and signal contacts. FIG. 5 depicts the modules 26 of FIG. 4 with the front housing 18 removed, and FIG. 6 is an enlarged view of the column of modules 26 on the left hand side of FIG. 5. The column of modules of FIG. 6 is used for illustration purposes. It will be appreciated that the columns are all similar. The modules 26 may each have a spline 27 that can be received in a corresponding slot (not shown) in the rear housing 18. Each of the modules 26 has a front housing 28 and a rear housing 30. The front housing 28 has openings 30 for receiving signal contacts, as explained in detail in the 926 Patent, of the pin connector 12 as described below. The front housing 28 provides electrical isolation from the signal contacts from each other and from the ground contacts.

The signal contacts are not described in more detail here, but they are described in detail in U.S. Pat. No. 6,116,926. The ground contacts 32 are shown in FIGS. 5–8. The ground contacts 32 slide into a slot in the modules as described in the 926 patent. FIGS. 5 and 6 depict the ground contacts 32 connected to the modules 26 so that the ground contacts slide over the front housings 28.

Figure 7:
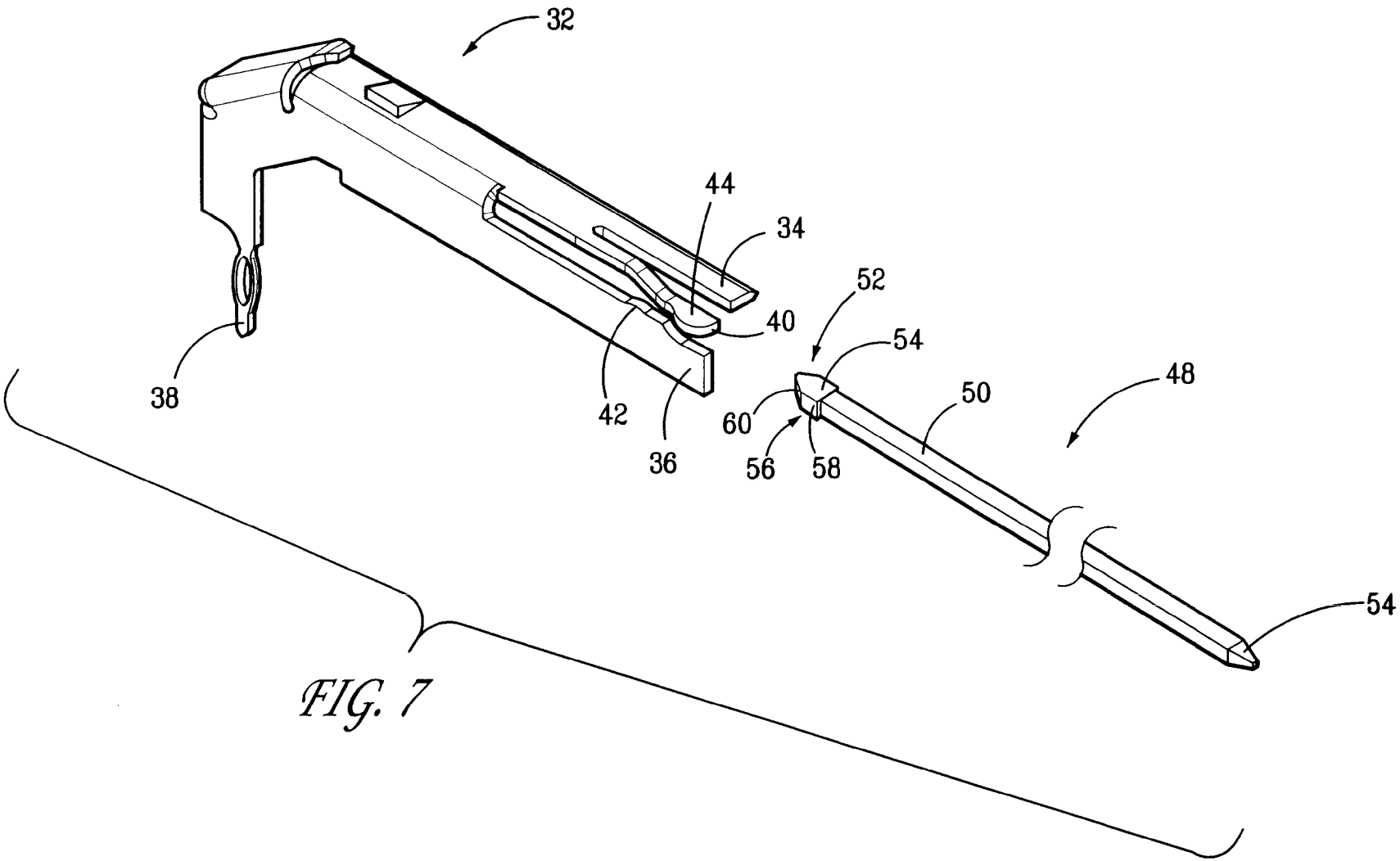
FIG. 7 is a perspective view of a pin according to a preferred embodiment of this invention and a receptacle contact of the second connector of FIG. 3.
Figure 8:
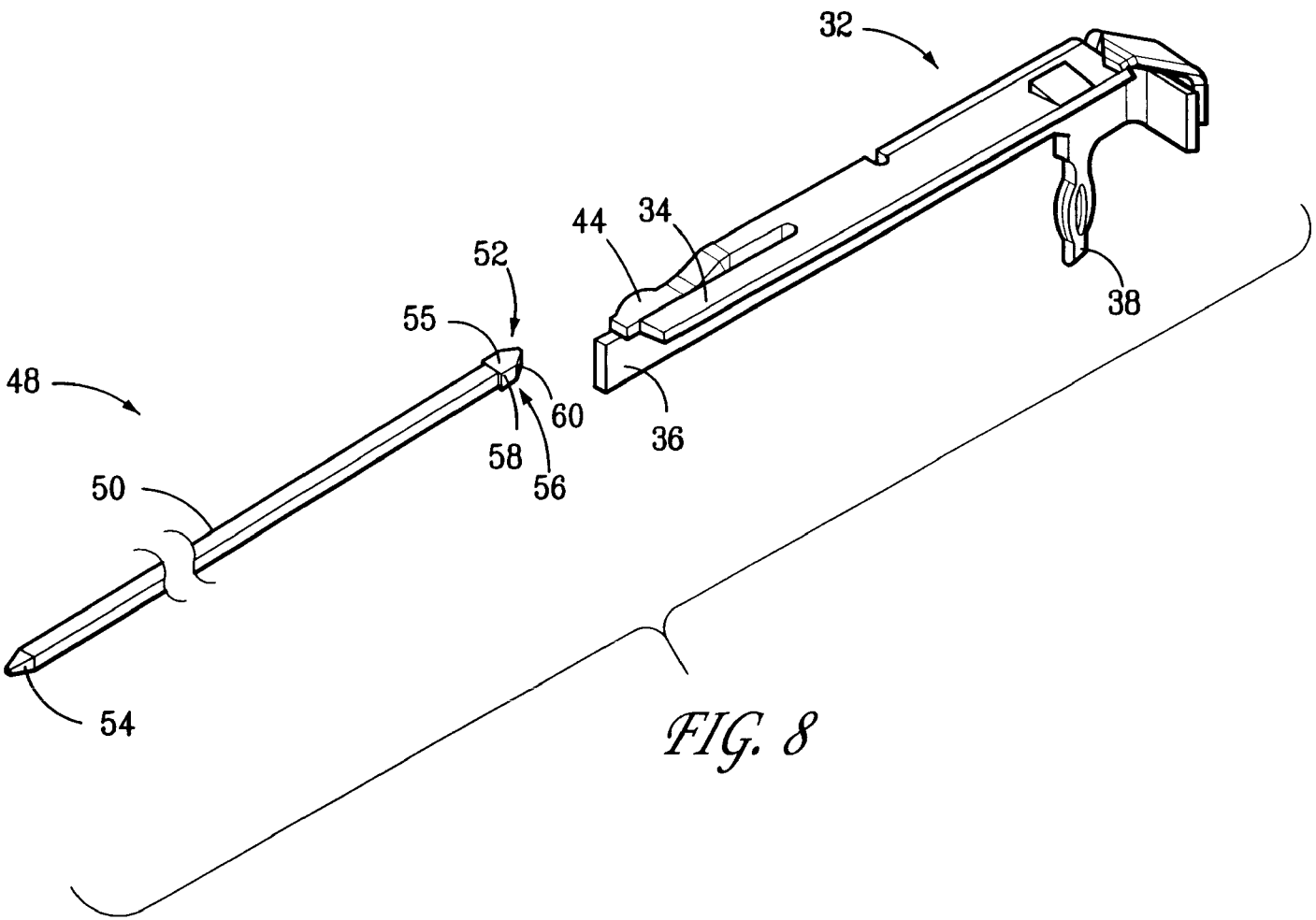
FIG. 8 is a second perspective view of the pin and receptacle contact of FIG. 7.

The ground contacts 32 are shown in detail in FIGS. 7 and 8. The ground contact 32 can receive a ground pin which is described in more detail below. The ground contact 32 has shielding tabs 34 and 36 that provide electromagnetic shielding to the electrical ground connection. The ground contact 32 may further have a terminal 38 for connection to another electrical component. As shown in FIGS. 7 and 8, the ground contact 32 may also have a pair of contact points 40, 42. One of the contact points 42 extends from the shielding tab 36, and the other contact point 40 is disposed on the cantilever 44. As explained in more detail below, a ground pin of the first connector 10 slides between the contact points 40, 42 to create an electrical connection.

Figure 9:
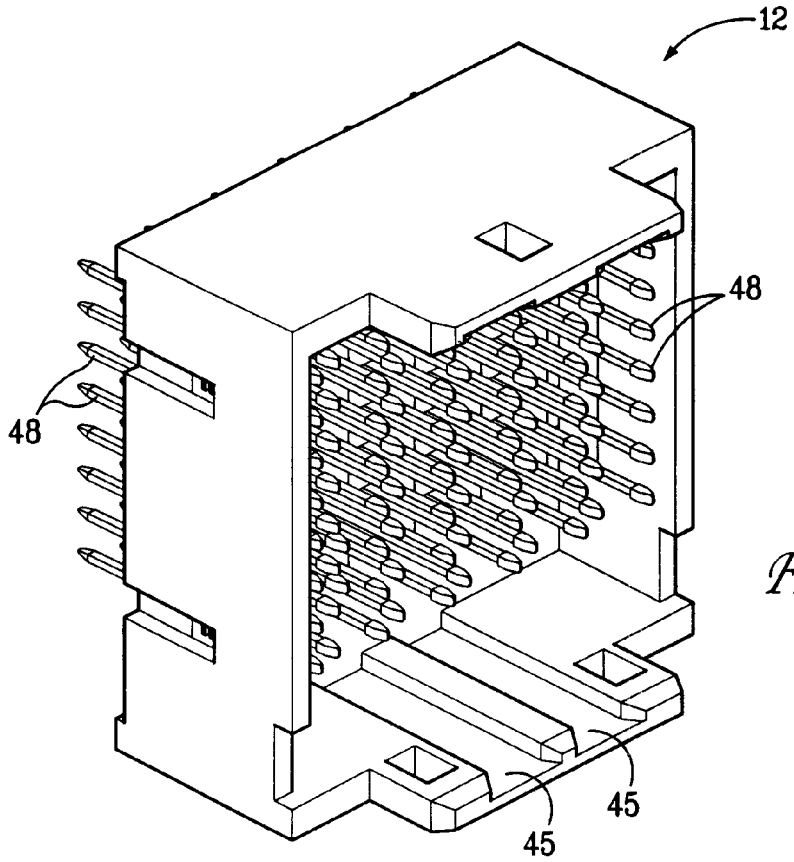
FIG. 9 is a perspective view of the first connector of FIG. 1 and the contact pins according to a preferred embodiment of this invention.

The first connector 12 of FIG. 1 is depicted detached from the second connector 14 in FIG. 2 and by itself in FIG. 9. The first connector 12 may be constructed from a polymer and preferably a high temperature thermal plastic. The first connector 12 and the second connector 14 can be attached in any of a variety of ways. In the preferred embodiment of the system, the first connector 12 has a plurality of slots 45 for receiving tabs 47 of the second connector 14, which are depicted in FIG. 3. By snapping the tabs 46 into the slots 45, the first and the second connectors 12, 14 can be attached as shown in FIG. 1. Everything that has been described thus far with the exception of the pins 48 is prior art to this invention, and the pins 48 which are described in more detail below are the novel part of this invention.

Disposed within the first connector 12 are a plurality of ground and signal pins 48. It will be appreciated that the ground and signal pins 48 are preferably all the same, and they are either a ground or a signal pin depending upon whether they are mated with a ground contact or a receptacle contact in the second housing 14. The pins 48 extend through the first connector 12 so that they extend from two sides of the connector 12. One side of the first connector 12 can attach to the second connector as shown in FIG. 1. The opposing side, which has extending pins, can attach to another corresponding electrical component (not shown).

The pins 48 can be mounted in any suitable fashion to the first connector 12. For instance, the pins 48 can be molded into slots (not shown), attached with an adhesive or soldered to the slots.

Figure 10:
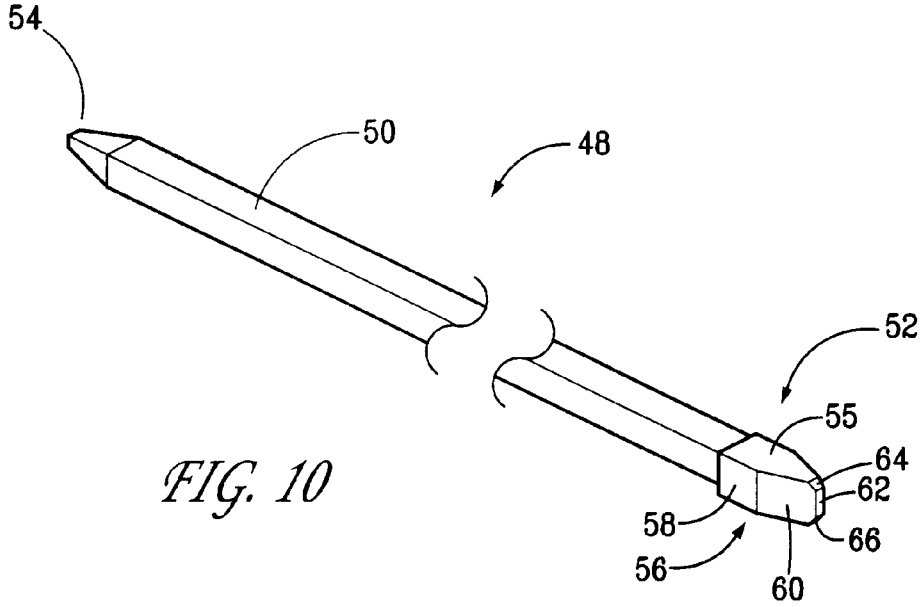
FIG. 10 is a perspective view of a pin according to a preferred embodiment of this invention.

A perspective view of one of the pins 48 is shown in FIG. 10. Although one pin 48 is described, it will be appreciated that all of the pins 48 of the first connector 12 are similar. The pins 48 may be stamped from phosphor bronze, beryllium copper or any suitable material. Other manufacturing processes can be used as well.

The pin 48 preferably has a stem 50 and two tips 52, 54. The stem 50 is preferably rectangular or square in cross-section, but it need not be and any suitable shape can be used. Coupled to each end of the stem 50 is a tip 52, 54.

The tip 52 has four sides two 55, 56 of which are shown in FIG. 10. Although only two sides 55, 56 are shown in FIG. 10, it will be appreciated that the two other pin sides are similar to one of the pin sides 55, 56. For example, if side 55 is considered the top in FIG. 10, the bottom side of the pin is similar in construction to the top side 55. Moreover, the other side of the pin is similar in construction to the side 56.

The side 55 is relatively flat and is disposed substantially parallel to the stem 50, as shown in FIG. 10. This will also be understood with reference to FIG. 11, which is an end view of the tip 52.

Figure 11:
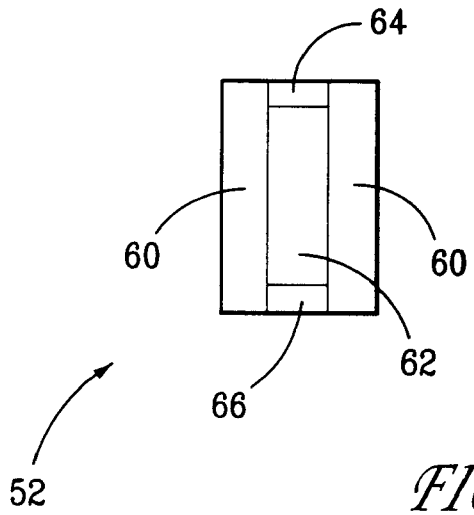
FIG. 11 is an end view of the contact pin of FIG. 10.

The side 56 preferable has two sections 58, 60. The first section 58 is disposed substantially parallel to the stem 50. The second section is disposed at an angle to the first section 58 and extends from the first section 56 to the end 62 of the tip 52, as shown in FIGS. 10 and 11. FIG. 11 also illustrates the angled section 60 of the side which is similar to the side 56.

The end 62 of the tip 52 is relatively flat and may be disposed substantially perpendicular to the stem 48. Two angled portions 64, 66 may connect the end 80 to the top and bottom sides, as shown in FIGS. 10 and 11.

Figure 12:
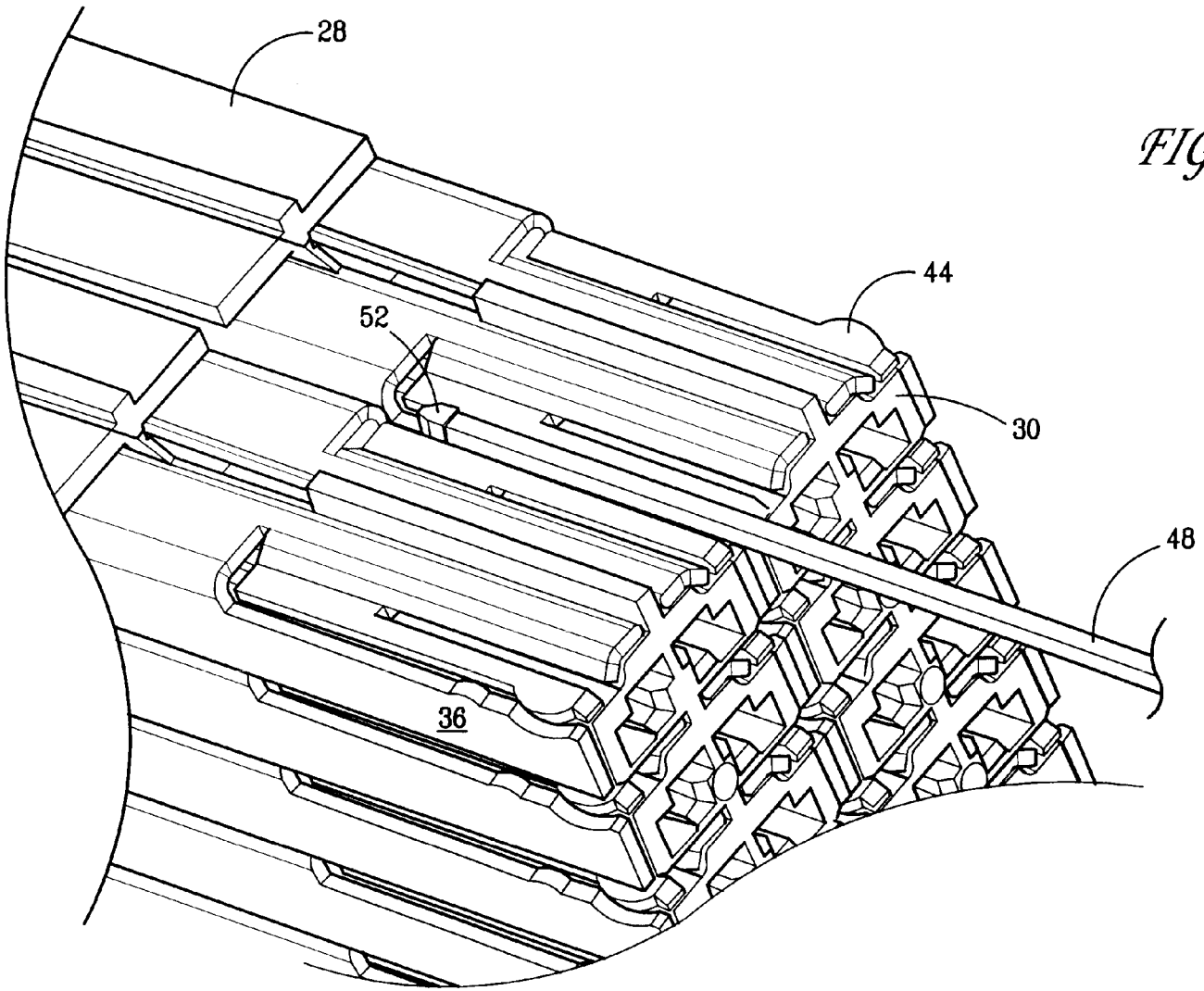
FIG. 12 is a perspective view of the contact pin of FIG. 10 being mated to a ground contact of the second connector.

The tip 52 construction prevents or minimizes side tracking of the pin as the pin is mating with a corresponding contact. FIGS. 7 and 8 depict a pin 48 aligned with a ground contact 32, and FIG. 12 illustrates a pin 48 being mated to a ground contact 32. The end 62 of the tip 52 is inserted between the contact points 42, 44 of a ground contact 32 of the connector 14. The angled side sections 62 help to align the pin between the contact points of the ground contact 32 as the pin is inserted into the contact. When further inserted, the tip top 54 and bottom sections due to their lager size and flat profile ensure that the pin will be aligned and not track to the side.

Figure 11A:
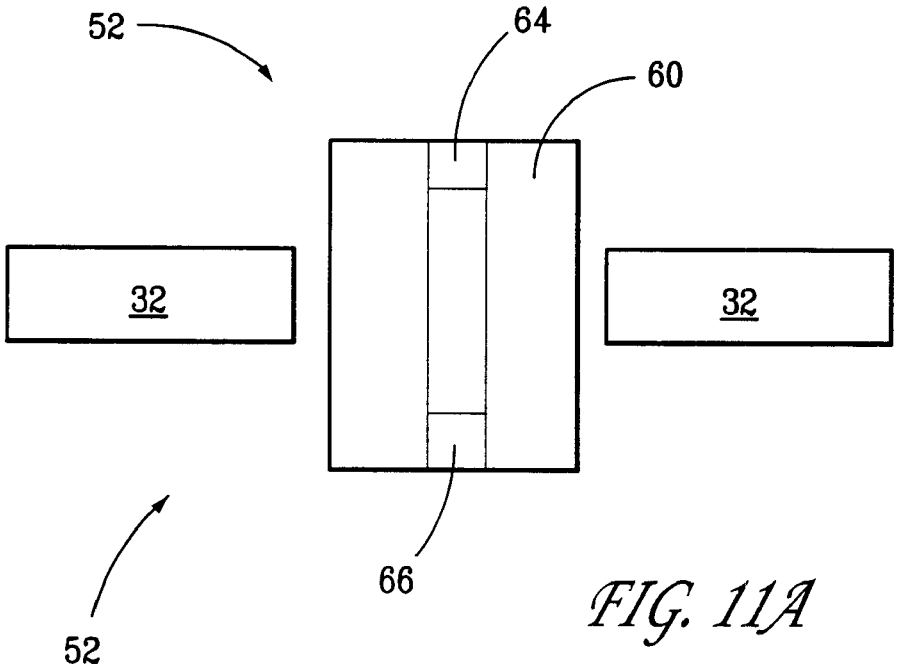
FIG. 11*a* is an end view of the contact pin of FIG. 10 being inserted between mating contacts.

This can also be understood with reference to FIG. 11*a*. As shown, the relatively large size of the pin tip 52, prevents the contacts 32 from side tracking or from riding on the sides of the pins to the top of the pins. By preventing this side tracking, the insertion forces are reduced, and unnecessary pin wear is prevented. This prevents unnecessary wear of the pin surfaces and premature pin failure.

As is shown in FIG. 7, the new pin tip 52 has an increased profile relative to that of the old pin tip 54, which may still be used on the opposing end of the pin 48. The increased profile of the pin tip 52 is designed such that it will prevent side tracking and also prevent friction forces when inserted into the window of the modules 26. The profiled tip is large enough and profiled to prevent side tracking, and small enough and profiled to prevent friction or rubbing against the walls of the modules 26.

Figure 13:
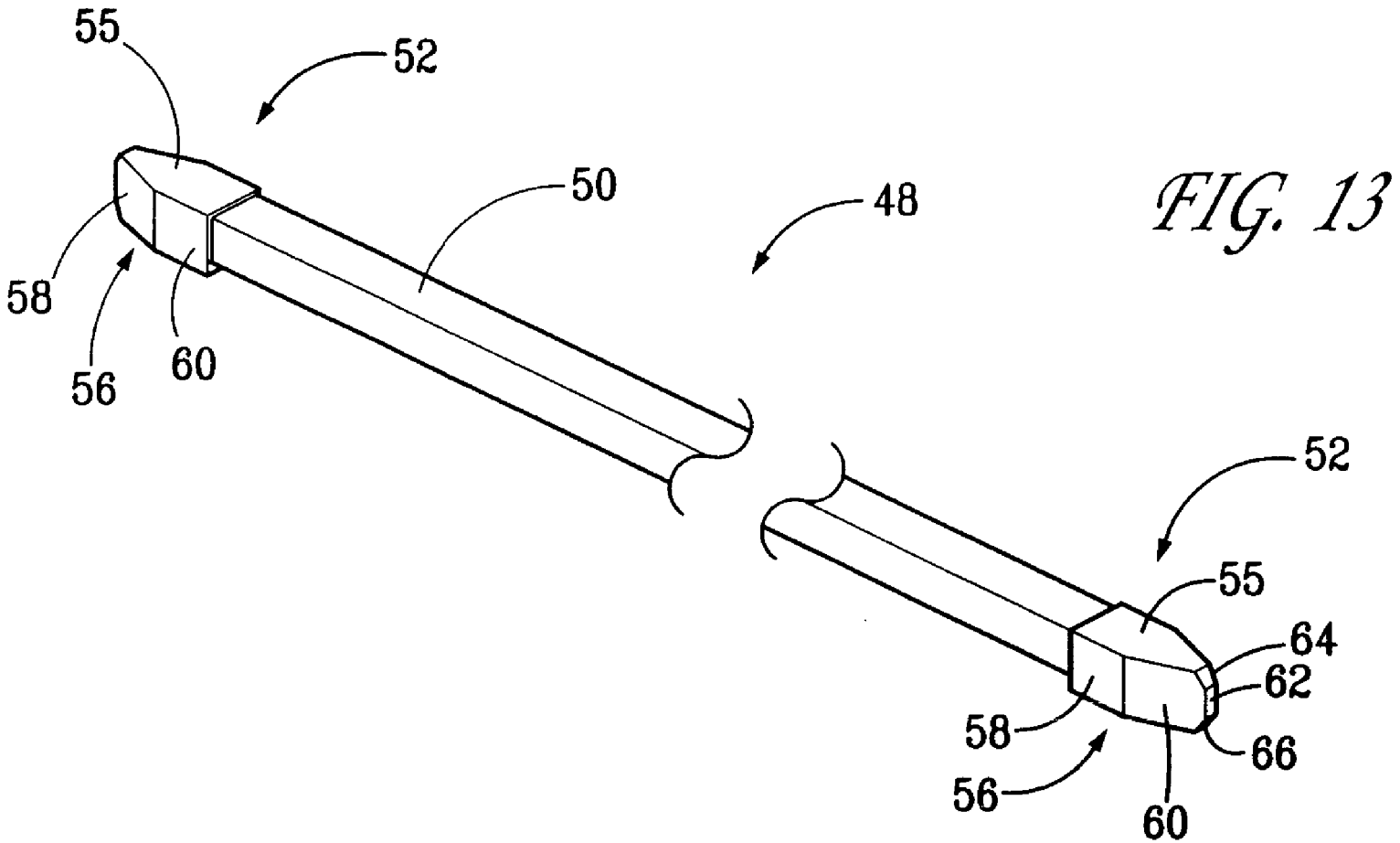
FIG. 13 is a perspective view of a second preferred embodiment of a pin of this invention.

FIG. 13 depicts a second preferred embodiment of this invention. In this embodiment of this invention. In this embodiment, the pin 48 has a tip 52 at either end. This embodiment is applicable mid-plane applications. In contrast, the first preferred embodiment having only one tip 52 is applicable in back plane applications.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An electrical connector system, comprising:

a first connector comprising at least one receptacle contact;

a second connector comprising at least one pin mated to the at least one receptacle contact; and the at least one pin comprising a stem comprising a first height and a first width, and a tip attached to the stem, the tip comprising a second height and a second width, the first width being measured along a same direction that the second width is measured, the first height being measured along a same direction that the second height is measured, such that the second height is greater than the first height and the second width is greater than the first width, the tip further comprising;

(a) an end;

(b) a first side that is disposed substantially parallel to the stem; and (c) a second side connected to the first side and comprising a first section that is disposed substantially parallel to the stem and a second section that extends at an angle from the first section to the end.

2. The electrical connector system of claim 1, wherein the at least one pin end is disposed substantially perpendicular to the stem and the stem and rip have substantially the same longitudinal axis.

3. The electrical connector system of claim 1, wherein the at least one pin further comprises a first angled portion which connects the end to the first side.

4. The electrical connector system of claim 1, wherein the at least one pin further comprises a third side which is connected to the second side and is disposed substantially parallel to the stem.

5. The electrical connector system of claim 1, wherein the pin tip first side is a top side and the second side is a lateral side.

6. The electrical connector system of claim 1, wherein the pin tip further comprises an angled portion that couples the pin first side to the pin end.

7. The electrical connector system of claim 4, wherein the at least one pin further comprises a first angled portion which connects the end to the first side and a second angled portion which connects the end to the third side.

8. The electrical connector system of claim 4, wherein the at least one pin further comprises a fourth side, which is connected to the first side and the third side, and comprises a first section that is disposed substantially parallel to the stem and a second section that extends from the first section of the fourth side to the end.

9. An electrical connector, comprising:

at least one pin comprising a stem comprising a first height and a first width, and a tip attached to the stem, the tip comprising a second height and a second width, the first width being measured along a same direction that the second width is measured, the first height being measured along a same direction that the second height is measured, such that the second height is greater than the first height and the second width is greater than the first width, the tip further comprising;

(a) an end;

a first side that is disposed substantially parallel to the stem; and (c) a second side connected to the first side and comprising a first section that is disposed substantially parallel to the stem and a second section that extends at an angle from the first section to the end.

10. The electrical connector of claim 9, wherein the at least one pin end is disposed substantially perpendicular to the stem and the stem and tip have substantially the same longitudinal axis.

11. The electrical connector of claim 9, wherein the at least one pin further comprises a first angled portion which connects the end to the first side.

12. The electrical connector of claim 9, wherein the at least one pin further comprises a third side which is connected to the second side and is disposed substantially parallel to the stem.

13. The electrical connector of claim 9, wherein the pin tip first side is a top side and the second side is a lateral side.

14. The electrical connector of claim 9, wherein the pin tip further comprises an angled portion that couples the pin first side to the pin end.

15. The electrical connector of claim 12, wherein the at least one pin further comprises a first angled portion which connects the end to the first side and a second angled portion which connects the end to the third side.

16. The electrical connector of claim 12, wherein the at least one pin further comprises a fourth side, which is connected to the first side and the third side, and comprises a first section that is disposed substantially parallel to the stem and a second section that extends from the first section of the fourth side to the end.

17. A contact pin, comprising:

a stem comprising a first height and a first width, a tip attached to the stem, comprising a second height and a second width, the first width being measured along a same direction that the second width is measured, the first height being measured along a same direction that the second height is measured, such that the second height is greater than the first height and the second width is greater than the first width, the tip further comprising:

an end;

a first side that is disposed substantially parallel to the stem; and second side connected to the first side and comprising a first section that is disposed substantially parallel to the stem and a second section that extends at an angle from the first section to the end.

18. The contact pin of claim 17, wherein the at least one pin end is disposed substantially perpendicular to the stem and the stem and tip have substantially the same longitudinal axis.

19. The contact pin of claim 17, wherein the at least one pin further comprises a first angled portion which connects the end to the first side.

20. The contact pin of claim 17, wherein the at least one pin further comprises a third side which is connected to the second side and is disposed substantially parallel to the stem.

21. The contact pin of claim 17, wherein the pin tip first side is a top side and the second side is a lateral side.

22. The contact pin of claim 17, wherein the pin tip further comprises an angled portion that couples the pin first side to the pin end.

23. The contact pin of claim 20, wherein the at least one pin further comprises first angled portion which connects the end to the first side and a second angled portion which connects the end to the third side.

24. The contact pin of claim 20, wherein the at least one pin further comprises a fourth side, which is connected to the first side and the third side, and comprises a first section that is disposed substantially parallel to the stem and a second section that extends from the first section of the fourth side to the end.

25. An electrical connector, comprising:

at least one pin, comprising a stem comprising a first height and a first width and a tip attached to the stem, the tip comprising a first height and a second width, the first width being measured along a same direction that the second width is measured, the first height being measured along a same direction that the second height is measured, such that the second height is greater than the first height the second width is greater than the first width, the tip further comprising:

(a) an end;

(b) a first side that is disposed substantially perpendicular to the end;

(c) a second side that is disposed substantially perpendicular to the end;

(d) a third side connected to the first and the second sides and comprising a first section and a second section that extends at an angle from the first section to the end.

26. The electrical connector of claim 25, wherein the tip further comprises a fourth side connected to the first and the second sides and comprising a first section and a second section that extends at an angle from the first section of the fourth side to the end.

27. The electrical connector of claim 25, wherein the pin tip first side is a top side and the second side is a lateral side.

28. The electrical connector of claim 25, wherein the pin tip further comprises an angled portion that couples the pin first side to the pin end.

* * * * *